US005183959A

United States Patent [19]

McCoan et al.

[11] Patent Number: 5,183,959

[45] Date of Patent: Feb. 2, 1993

[54] SEMI-AUTOMATIC FIREARM HAVING A SAFETY DEVICE PREVENTING CONVERSION TO FULL AUTOMATIC FIRING

[75] Inventors: Horace C. McCoan, Manchester; James V. Collier, Vernon, both of Conn.

[73] Assignee: Colt's Manufacturing Company Inc., West Hartford, Conn.

[21] Appl. No.: 561,450

[22] Filed: Aug. 1, 1990

[51] Int. Cl.[5] ..... F41A 19/00

[52] U.S. Cl. ..... 89/148; 89/146

[58] Field of Search ..... 42/69.03, 70.01, 70.06; 89/128, 139, 144, 145, 146, 148

[56] References Cited

U.S. PATENT DOCUMENTS

| | | | |
|---|---|---|---|
| 3,045,555 | 7/1962 | Stoner | 89/142 |
| 3,292,492 | 12/1966 | Sturtevant | 89/128 |
| 3,431,819 | 3/1969 | Koucky et al. | 89/145 |
| 3,670,442 | 6/1972 | Kennedy et al. | 42/70.08 |
| 4,433,610 | 2/1984 | Tatro | 89/148 |
| 4,522,105 | 6/1985 | Atchisson | 89/139 |
| 4,658,702 | 4/1987 | Tatro | 89/139 |
| 4,891,898 | 1/1990 | Houseman | 89/128 |
| 4,937,964 | 7/1990 | Crandall | 42/69.03 |

*Primary Examiner*—Stephen C. Bentley
*Attorney, Agent, or Firm*—Perman & Green

[57] ABSTRACT

An anti-conversion block for use with a semi-automatic firearm and a method of manufacturing a semi-automatic firearm. The anti-conversion block prevents the conversion of the firearm into a fully automatic firearm. The block is fixedly mounted in the lower receiver of the firearm with pins press fit through the lower receiver into blind holes in the block. The block has a first section for preventing operational installation of a trigger other than a predetermined type of trigger into the firearm, a second section for preventing operational installation of a hammer other than a predetermined type of hammer into the firearm, and a third section for preventing operational installation of a bolt assembly other than a predetermined type of bolt assembly into the firearm.

15 Claims, 6 Drawing Sheets

206
224
244
228
232
226
234
212
256
260
258
210
252
249
216
242
219
254
215
240
248
250
214
218
208
201
237
238
236
200
247
247
246
28

SEMI-AUTOMATIC FIREARM HAVING A SAFETY DEVICE PREVENTING CONVERSION TO FULL AUTOMATIC FIRING

BACKGROUND OF THE INVENTION

1. Field of the Invention

The present invention relates to firearms and, more particularly, to a safety system for semi-automatic firearms which is intended to prevent the conversion of a semi-automatic firearm into a fully automatic firing firearm.

2. Prior Art

Numerous semi-automatic firearms in the prior art may be converted into fully automatic firing firearms by minor alterations and/or removal or replacement of the parts of firing system. In many semiautomatic firearms, this conversion can be effected in a relatively short period of time.

U.S. Pat. No. 3,670,442 provides an arrangement for a semi-automatic firearm whereby removal or alteration of the components of the firing mechanism will not render the firearm automatic. The noted patent shows means which will automatically keep the firearm from being converted into a machine gun by the alternation and/or removal of existing parts. The Patent discloses a hammer including a stop abutment thereupon which is adapted, under certain conditions, to prevent the return of the bolt assembly to the battery position from the recoil position.

Specifically, should the disconnector or hook sear be removed from the mechanism, the stop abutment will engage a surface on the bolt assembly during forward movement of the bolt assembly from its recoil position. Thus, even if the disconnector is removed, the mechanism will prevent a firearm, in which it is incorporated, from firing automatically due to the engaging contact between the stop abutment and the bolt assembly during forward movement of the bolt assembly. Although an arrangement similar to that shown in U.S. Pat. No. 3,670,442 is well suited to firearms adapted for blowback operations, removal of the stop abutment on the hammer could possibly permit automatic firing operation.

U.S. Pat. No. 4,658,702 to Tatro discloses a safety device preventing conversion to full automatic firing having a stop abutment on its hammer adapted to engage an abutment surface in the bolt assembly even if its disconnector is removed or altered. However, this type of safety device could be overcome by replacing the hammer and/or bolt assembly with replacements parts not having these abutment surfaces.

It is therefore an objective of the present invention to provide a new and improved safety device and system that can overcome disadvantages of the prior art as well as provide additional features.

SUMMARY OF THE INVENTION

The foregoing problems are overcome and other advantages are provided by an anti-conversion block for use in a semi-automatic firearm for preventing replacement of the components of the semi-automatic firing mechanism with fully automatic capable firing mechanism components and thereby preventing conversion of the firearm to a fully automatic firearm, and a method of manufacturing a semi-automatic firearm.

In accordance with one embodiment of the present invention, an anti-conversion block for use in a semi-automatic firearm for preventing conversion of the firearm to a fully automatic firearm is provided. The block comprises three sections. A first section has means for preventing operational installation of a predetermined type of trigger into the firearm. A second section has means for preventing operational installation of a predetermined type of hammer into the firearm. A third section has means for preventing the operational installation of a predetermined type of bolt assembly into the firearm.

In accordance with another embodiment of the present invention a semi-automatic firing mechanism of the type having a receiver, a bolt assembly mounted for longitudinal movement in the receiver between recoil and battery positions, a hammer pivotably mounted in the receiver such that movement of the bolt assembly from the battery position to the recoil position urges the hammer into a cocked position, a firing pin slidably mounted in the bolt assembly adapted to be displaced into engagement with a cartridge upon being struck by the face of the hammer is provided. The improvement comprises an anti-conversion block fixedly mounted in the receiver that can prevent the conversion of the semi-automatic firing mechanism into a fully automatic firing mechanism.

In accordance with another embodiment of the present invention a semi-automatic firearm having a barrel, an upper receiver, a reciprocating bolt movably mounted inside the upper receiver, a firing pin slidably mounted in the bolt, and a lower receiver having a trigger actuated firing mechanism is provided. The improvement comprises an anti-conversion block fixedly mounted to the lower receiver. The block has a forward section extending into an area behind a hammer operating area of the firing mechanism that does not interfere with the operation of a first type of hammer, but upon replacement of the first type of hammer with a second type of hammer, prevents operation of the second type of hammer by blocking the second type of hammer from full rearward movement.

In accordance with another embodiment of the present invention a semi-automatic firearm having a barrel, an upper receiver, a reciprocating bolt movably mounted inside the upper receiver, a firing pin slidably mounted in the bolt, and a lower receiver having a trigger actuated firing mechanism is provided. The improvement comprises an anti-conversion block fixedly mounted to the lower receiver. The block has a bottom section extending into an area behind a trigger mechanism such that the trigger mechanism cannot be replaced with a different type of trigger mechanism.

In accordance with another embodiment of the present invention, a semi-automatic firearm having a barrel, an upper receiver, a reciprocating bolt movably mounted inside the upper receiver, a firing pin slidably mounted in the bolt, and a lower receiver having a trigger actuated firing mechanism is provided. The improvement comprises an anti-conversion block fixedly mounted to the lower receiver. The block has a top section extending into the upper receiver. The bolt assembly has an elongate slot for receiving the top section and being moveable relative thereto such that upon replacement of the bolt assembly with a different type of bolt assembly not having at least as long an elongate slot, the firearm is unable to operate properly.

In accordance with one method of the invention, a method of manufacturing a semi-automatic firearm is provided comprising the steps of providing a lower receiver with a cavity for housing a firearm mechanism; mounting a fire control selector on the lower receiver, the selector projecting into the lower receiver cavity and being moveable on the lower receiver; mounting an anti-conversion block in the cavity of the receiver, the block having a first notch adapted to substantially accommodate the selector in the cavity and a second notch adapted for movement of a portion of the trigger mechanism therein, the block being fixedly attached to the lower receiver by press fitting pins through the lower receiver into blank holes in the block; and mounting a trigger and hammer mechanism of the firing mechanism in the cavity.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
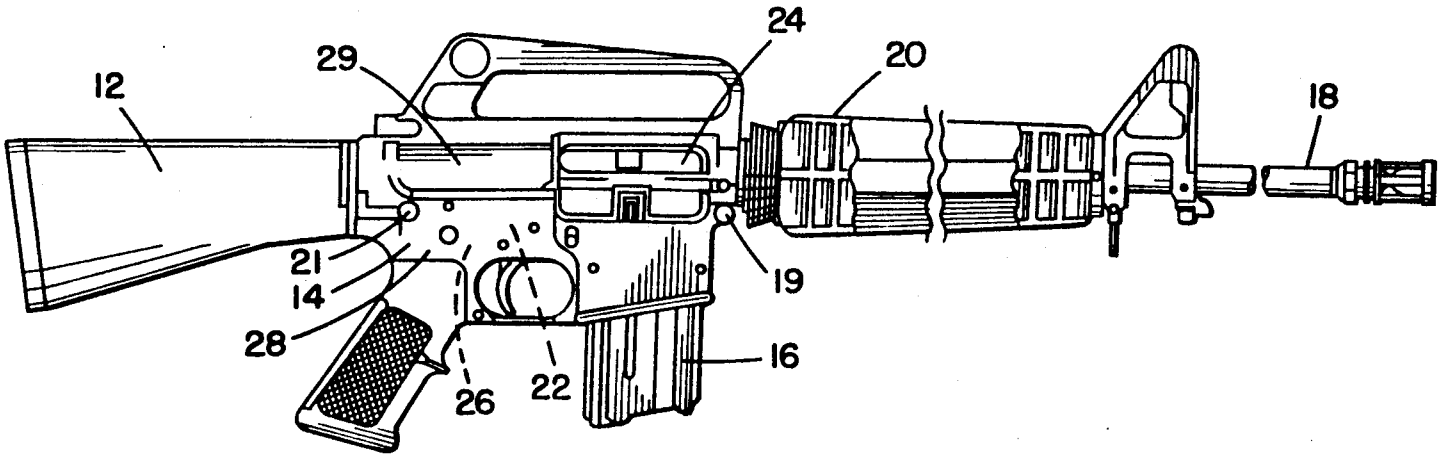
FIG. 1 is a plan side view of a semi-automatic firearm incorporating features of the present invention.

Referring to FIG. 1, there is shown a plan side view of a semi-automatic rifle 10 incorporating features of the present invention. The rifle 10 is similar in its exterior profile to the M-16 rifle used by the United States armed forces, but is not capable of automatic firing as the M-16. Although the present invention is being described with the embodiment shown in FIG. 1, it should be understood that the present invention can be used with any gas operated or blow back type of semi-automatic firearm including pistols. In addition, it should also be understood that the present invention can incorporate any suitable size, shape, or type of elements and suitable type of materials without departing from the spirit of the invention. In the embodiment shown in FIG. 1, the firearm 10 includes a stock 12 mounted on a receiver 14. The receiver 14 has a cartridge magazine 16 mounted therein. A barrel 18 is operatively connected to the receiver 14 and has a hand grip 20 mounted thereupon for isolating the hand of a shooter from direct contact with the barrel 18. The receiver 14 generally houses a firing mechanism 22 which generally includes a bolt assembly 24 (see FIGS. 9A and 9B) and a trigger mechanism 26. The receiver 14 is generally comprised of metal and has a lower receiver 28 and an upper receiver 29 which are held together by two pins or screws 19 and 21. The lower receiver 28 generally houses the trigger mechanism 26 and the upper receiver 29 is generally provided with a longitudinal cavity or chamber into which the bolt assembly 24 is reciprocably mounted therein.

Figure 2:
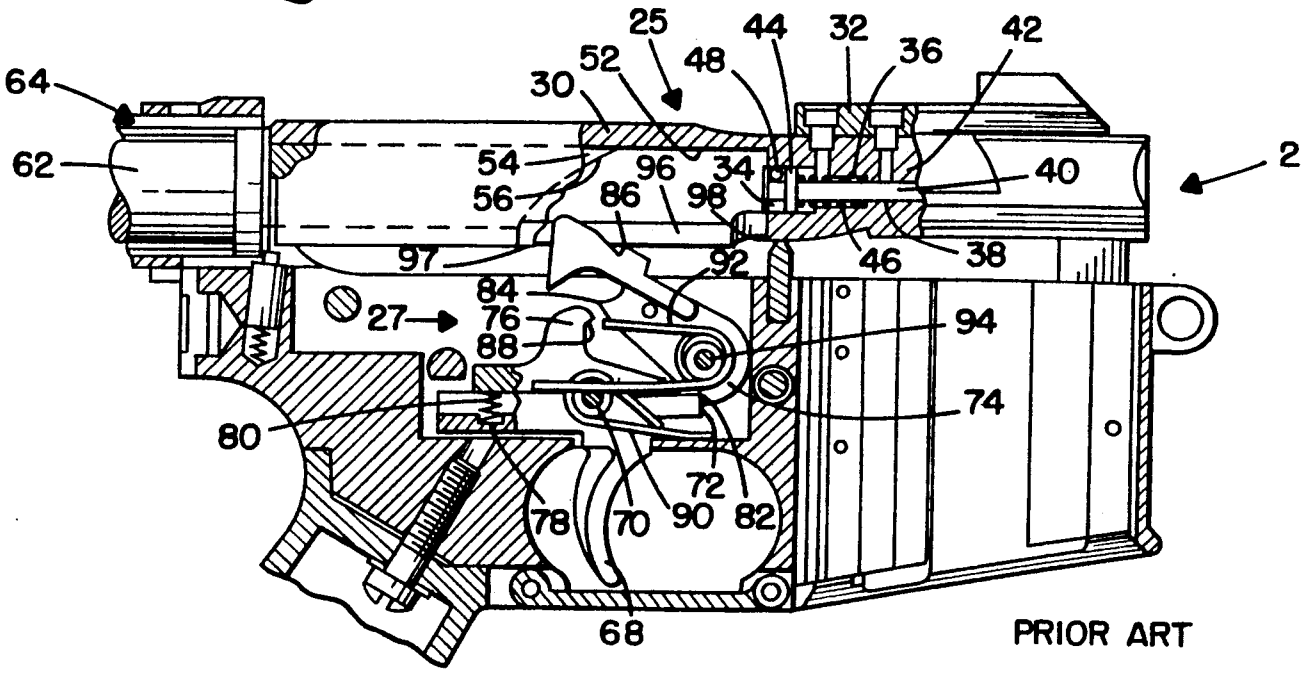
FIG. 2 is a partial cross-sectional view of an upper and lower receiver and firing mechanism of a semi-automatic firearm known in the prior art.
Figure 9A:
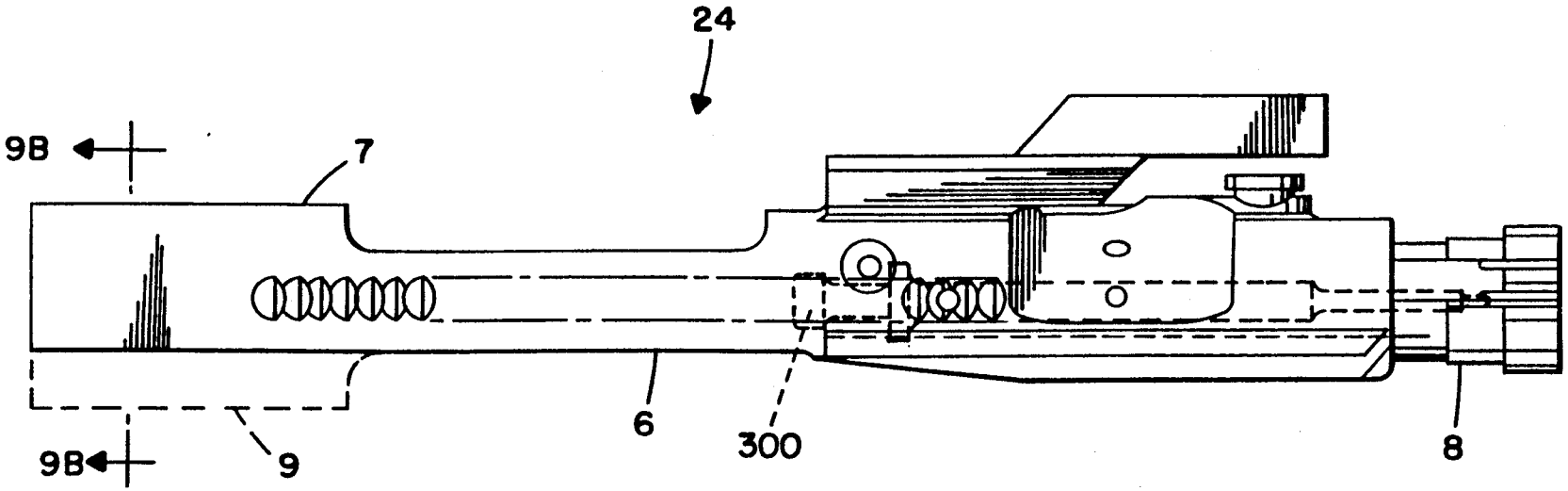
FIG. 9 is a plan side view of a bolt assembly used in the firearm shown in FIG. 1.
FIG. 9B is a cross-sectional view of the bolt assembly shown in FIG. 9A taken along line 9B-9B.
Figure 9B:
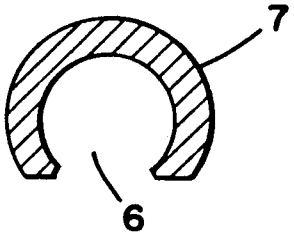

Referring also to FIGS. 9A and 9B, the bolt assembly 24 is of the gas operated type and comprises a bolt carrier 7, a bolt 8 and a firing pin (not shown). Before preceding to describe the present invention, a better understanding of the features of the present invention will be understood by first reviewing the firing mechanisms of similar semi-automatic and automatic weapons known in the prior art. Referring now to FIG. 2 the firing mechanism and lower receiver of the firearm 2 described in U.S. Pat. No. 4,658,702 is shown.

The receiver 14 of the present invention is similar to M-16 style receivers of the prior art such as the receiver shown in FIG. 2 with exceptions as noted below. The bolt assembly 25 for the prior art embodiment shown in FIG. 2 is of the blowback type and comprises a bolt 30 and a bolt key 32 integral therewith and immovably connected thereto. The bolt 30 has three communicating longitudinal cylindrical bores therein 34, 36 and 38 which receive an inertia firing pin, generally shown at 40. Firing pin 40 comprises a shaft 42 mounted for sliding movement within the bore 38 and having an enlarged diameter portion 44 slidably mounted in the bore 34. A compression spring 46, surrounding the firing pin 40 in coaxial fashion, extends through the annular volume defined between the outer periphery of the firing pin 40 and the cylindrical wall of bore 36 and seats against the enlarged diameter portion 44 and the annular area at the base of passage 36. The spring 46 urges the firing pin 40 to the rear such that the enlarged diameter portion 44 engages a firing pin retaining pin 48 secured to the bolt 30. When the bolt assembly 25 occupies its battery position in the forward extremity of the upper receiver (not shown) and firing pin 40 is struck upon its rear extremity, the firing pin 40 is adapted to be displaced forwardly, against the bias of the spring 46, such that is tip engages and fires a chambered cartridge.

The bolt 30 embodies a cavity 52 in its rear portion to allow for machining of the bores in which the firing pin is mounted and to permit hammer rotation. Inserted in the cavity 52 is a plug 54 having a sloping forward wall 56. Plug 54 is secured to the bolt carrier by means of a pin (not shown) press fitted into a hole (not shown) in the plug 54. The wall 56 of the plug permits removal and replacement of the firing pin 40 and allows for hammer rotation. The rear extremity of the bolt assembly 25 is in abutting contact with a buffer 62 (partially shown), housed in a receiver extension 64 which is threadedly secured to the receiver.

Upon firing the firearm illustrated in FIG. 2, the bullet passes outwardly through the barrel under the impetus of the expanding powder gases. The weight of the bolt assembly 25 and the buffer 62 will cause sufficient delay in extracting the empty cartridge case so as not to cause the cartridge case to rupture. The empty cartridge case imparts a rearward momentum to the bolt assembly 25 which is absorbed by the compression of an operating spring (not shown) until the bolt assembly has reached its recoil or retracted position. During the recoil stroke the empty cartridge case will be retained in engagement with the bolt assembly by the usual cartridge extractor until striking a fixed ejector in the usual manner whereupon the case will be expelled from the receiver. Upon dissipation of the rearward momentum of the bolt assembly 25, the operating spring acting upon the buffer 62 returns the bolt assembly to the battery position which, stripping a fresh cartridge from the magazine 16 during the counter recoil stroke, chambers the stripped cartridge in the barrel.

The trigger mechanism 27 is similar in design and operation to that mechanism described in U.S. Pat. Nos. 3,045,555 and 3,670,442 and, of course, is designed to furnish only semi-automatic operation of the firearm 2. The trigger mechanism 27 comprises a trigger 68 which is pivotally mounted within the lower receiver section by transversely oriented pivot pin 70. Trigger 68 has an elongated upper portion which includes a forward trigger sear 72 adapted, in a manner hereinafter described, to retain a hammer 74. Additionally mounted on the pivot pin 70 is a disconnector 76, the lower portion of which is located within a groove 78 in the upper portion of the trigger 68. A compression spring 80 is interposed between the bottom of the groove and the under side of the disconnector 76 in order to urge the disconnector in a clockwise direction about pivot pin 70.

The hammer 74 is provided with a first sear abutment 82 in the forward portion thereof and a second sear abutment 84 in the intermediate portion thereof. The hammer 74 is also provided with a bolt stop abutment 86 adjacent the face thereof which is adapted to engage the bolt assembly 25 in a manner hereinafter described.

The disconnector 76 includes a vertically extending portion which incorporates a hook sear abutment 88. The trigger 68, by virtue of its pivotal mounting on pin 70, is adapted to pivot from a first position, in which the sear 72 thereof engages the first sear abutment 82 of the hammer 74, to a second position angularly spaced in a clockwise manner from the first position, in which the hook sear abutment 88 on the disconnector 76 engages the second abutment 84 of the hammer 74. The hammer 74 is maintained in a cocked nonfiring position by the cooperative interengagement between either the trigger sear 72 and the first sear abutment 82 or the hook sear abutment 88 and the second sear abutment 84, the interengagements being respectively maintained by the bias of a trigger spring 90 and the pressure of the shooter's finger.

Upon rearward pivotal movement of the trigger 68 about its pivot pin 70 against the bias of the trigger spring 90, the hammer 74 swings upwardly under the bias of a hammer spring 92 about is mounting pivot 94. During upward swinging between a cocked position and a firing position, in which it contacts the firing pin 48, the hammer passes through a bottom longitudinal aperture or slot 96 formed in the lower portion of the bolt 30 and having a base or terminus 97. Upon striking the firing pin 40, a chambered cartridge is fired from the barrel 18. When the bolt assembly 25 recoils the hammer 74 is urged by the carrier 32 in a downward or counterclockwise direction. Assuming that the trigger 68 is retained in its depressed or second position during this downward movement of the hammer 74, the second sear abutment 84 of the hammer 74 will engage the hook sear abutment 88 of the disconnector 76 after slightly displacing the disconnector in a counter-clockwise direction about the pivot 70. Conversely, if the trigger 68 is immediately returned to its first position after the firing of the chambered cartridge, the hammer 74 will be retained in its cocked position by the engagement of the trigger sear 72 and the first sear abutment 82. Normally, the trigger will be momentarily retained in its second position after the weapon has been fired, and thus the recoil of the bolt assembly 24 normally causes the second sear abutment 84 to engage hook sear abutment 88. When the trigger is released after this engagement has been effected, the trigger sear 72 will move into engagement with the first sear abutment 82 after the second sear abutment 84 and the hook sear abutment 88 move out of engagement. After this occurs, the mechanism is poised to fire another cartridge by the shooter pulling against the trigger again.

The bolt 30 incorporates an abutment surface 98 adapted to contact the bolt stop abutment 86 on the hammer. If the second sear abutment 84 and the hook sear abutment 88 fail to engage one another due to the removal, alteration or breakage of abutment 88 or abutment 84, or the complete removal of the disconnector 76 from the mechanism, the stop abutment 86 will engage the abutment surface 98 during counter recoil of bolt assembly 24.

Figure 3:
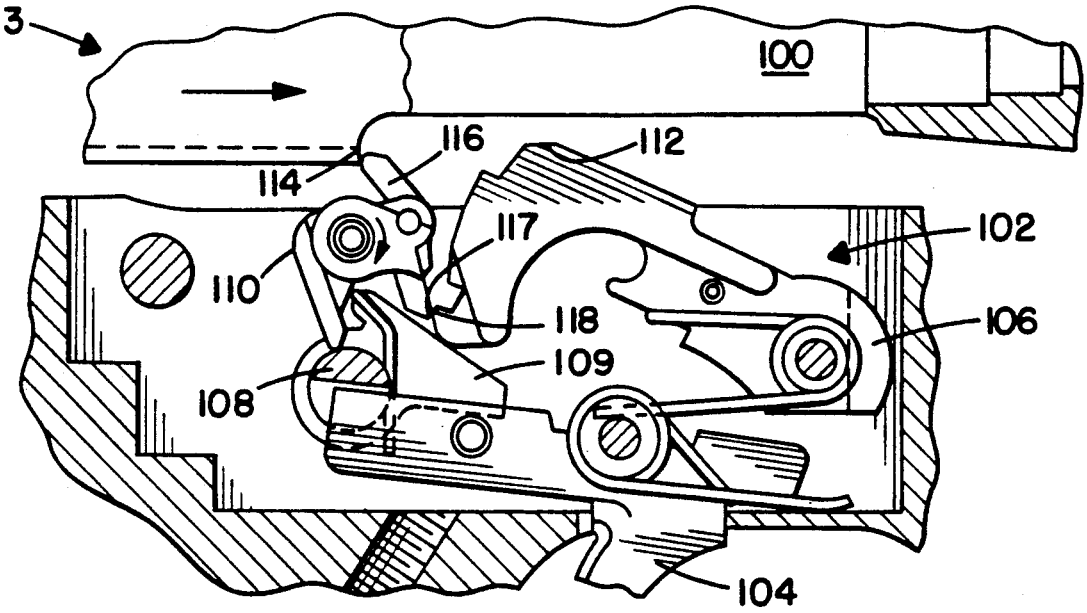
FIG. 3 is a partial cross-sectional view of the firing mechanism to an automatic firing weapon known in the prior art.
Figure 5:
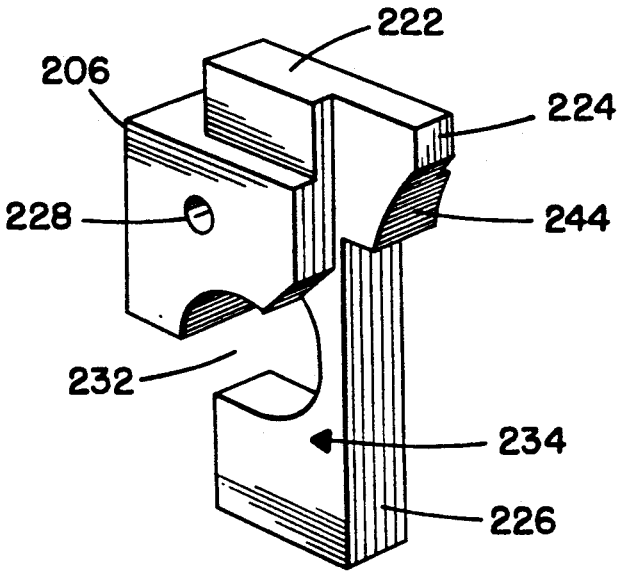
PRIOR ART FIG. 5.
FIG. 5 is a perspective view of the anti-conversion block shown in the lower receiver of FIG. 4.

Referring now to FIG. 3, the firing mechanism of a firearm capable of automatic firing having a similar type of receiver as in FIG. 2 is shown. The operation of the automatic weapon is accomplished by rotating the handle of the common control member into an automatic firing position. The firing mechanism has a bolt assembly 100 and trigger assembly 102 having a trigger 104, a hammer 106, a safety selector 108, a connector 109, and an automatic sear 110. This is an open bolt firing mechanism as described in U.S. Pat. No. 4,433,610. The bolt 100 is normally retained in a recoil position by a sear abutment (not shown) on the bolt assembly 100 and a sear abutment 112 of the hammer 106. As the trigger 104 is pulled, the connector 109 produces a clockwise rotation of the automatic sear 110. This results in the automatic sear 110 causing the hammer to move downwardly such that the sear abutment (not shown) on the bolt assembly 100 and the sear abutment 112 of the hammer slide out of engagement. The bolt assembly commences movement towards its battery position under the impetus of the operating spring (not shown).

In the embodiment shown in FIG. 3, the bolt assembly 100 continues its forward motion to a point where a shoulder 114 on the bolt assembly 100 engages a leg 116 of the automatic sear 110 and rotates the automatic sear to a position where a searing surface 117 of the automatic sear 110 is about to slide out of enqagement with a sear abutment 118 on the hammer 106. Upon the bolt assembly 100 reaching its battery position, the shoulder 114 has pivoted the automatic sear 110 a few degrees further to a position where the two sear surfaces 117 and 1 18 are disengaged. Such disengagement permits the hammer 106 to fall and strike the firing pin (not shown). Firing is repeated automatically until such time as the shooter releases the trigger 104.

The primary problem that is addressed by the present invention is to prevent conversion of a firearm having a semi-automatic firing mechanism into an automatic firearm having a fully automatic firing mechanism. In the past, semi-automatic M-16 style firearms have been illegally converted into automatic firing firearms by replacing components of the semi-automatic firing mechanism with components of an automatic firing mechanism including the trigger, disconnector, hammer, and bolt assembly. A further type of illegal conversion includes addition of an add-on mechanism or follower that is attached to the bottom of a bolt carrier that interacts with the firing mechanism to allow for automatic firing. Yet a further type of illegal conversion includes the insertion and mounting of an automatic sear, similar to the automatic sear 110 described in FIG. 3, into the lower receiver of a semi-automatic M-16 style firearm that allows for automatic firing. Although various safety systems have been incorporated into semi-automatic firearms in the past, such as described with reference to FIG. 2 above, because the M-16 type receivers of firearms, such as those shown in FIGS. 2 and 3, are very similar, it was nonetheless possible to over come the safety systems by replacing portions of semi-automatic firing mechanisms with components of fully automatic firing mechanisms or adding components. The present invention uses an anti-conversion block that is fixedly located in the receiver 14 to prevent replacement of the semi-automatic firing mechanism 22 with a fully automatic firing mechanism.

Referring now to FIGS. 1 and 4–9, the lower receiver 28 and upper receiver 29 of the rifle 10 is substantially the same as in the prior art with the exception of three additional pin holes 200, 201 and 202 in the lower receiver 28 and, the size of the pivot pin holes 246 an 247 for the hammer retaining pin 219 and trigger retaining pin 218. Mounted in the lower receiver cavity 204 is the trigger mechanism 26 and the block 206. The trigger mechanism 26 generally comprises a trigger 208, a hammer 210, a disconnector 212, and three springs 214, 215 and 216. Two pins 218 and 219 mount the firing mechanism 22 to the lower receiver 28. The lower receiver 28 also has a safety or selector switch 220 that passes into the lower receiver cavity 204 that can, at least partially, control movement of the trigger 208. The trigger mechanism 26 operates substantially similar to the trigger mechanism described with reference to FIG. 2 above, but has certain physical differences to allow it to work with the anti-conversion block 206 as will be described below.

The block 206 is generally comprised of metal and has a top section 222, a front section 224, a bottom section 226, three blind holes 228, 229 and 230, a first notch 232 and a second notch 234. It should be understood that the block 206 need not be solid, but is merely provided as a motion blocker to block or limit the motion of firing mechanism components other than those provided with the firearm 10 by the manufacturer and, to prevent or block the use and/or installation of an automatic sear or an automatic follower described above. In a preferred embodiment the block 206 is comprised of solid steel. The three blind holes 228–230 are aligned with the pin holes 200–202 in the lower receiver 28 and hardened steel pins 236, 237 and 238 are press fit into the holes 228–230 and 200–202 to fixedly mount the block 206 to the lower receiver 28. Although the pins 236–238 are described in the embodiment shown as being press fit into the block 206, it should be understood that any suitable means may be used to fix the block 206 in the lower receiver 28 including welding, adhesive, interference fit, etc. The block 206 is preferably made of steel and inserted into the lower receiver cavity 204 before the pins 236–238 are inserted. However, the block may be unitarily formed with the lower receiver 28. The top two holes 228–229 are, in the embodiment shown, aligned but slightly offset from each other. Generally, this aligned but slightly offset configuration of the two upper pins 237, 238 and holes 228, 229 is provided for two reasons. First, in an attempt to remove the block 206, a person might attempt to drill through the block 206 to the inner most portion of a pin (the pin base) and attempt to punch or push out the pin in the reverse direction that the pin was inserted into the block 206. Because the two upper pins 237 and 238 are aligned, a person would have to attempt to drill through an opposite hardened steel pin in order to get to the pin base of one of the upper pins. Thus, virtually eliminating the risk of this type of removal of the block 206 due to the extreme difficulty in attempting to drill through hardened steel. Second, a person, in an attempt to remove block 206, and due to the aligned nature of the two upper pins 237 and 238, might attempt to punch or push out both pins 237 and 238 at the same time. Because the upper two pin holes 228 and 229 are relatively long in order to get the most amount of engagement area with the pins 236 and 237 and, the holes 228 and 229 are aligned, there is relatively little block material between the two pin holes 228 and 229. Thus, in order to prevent a person from attempting to push or punch out both upper pins 236 and 237 at the same time, the two upper pin holes 228 and 229 are slightly offset from each other thereby preventing this type of attempted removal of the pins and block.

The first notch 232 is generally provided to accommodate the selector switch 220. The second notch 234 is generally provided to accommodate a rear portion 240 of the trigger 208. As can be seen best in FIG. 8, the rear portion 240 of the trigger 208 does not have the same profile or width as the remainder of the trigger 208. A rear side section of the trigger 208 has been cut away such that a gap 242 is formed at the side of the rear of the trigger. The rear portion 240 of the trigger is thus offset on one side of the trigger 208. As noted above, the block 206 has a second notch 234 generally provided to accommodate the rear portion 240 of the trigger 208. Thus, with the trigger 208 and block 206 mounted in the lower receiver 28, the rear portion 240 of the trigger is located in the second notch 234 for movement therein and the bottom section 226 of the block 206 is located in the rear gap 242 of the trigger 208. Hence, the block 206 prevents replacement of the trigger 208 with another type of trigger, such as shown in FIGS. 2 and 3, that does not have a gap in its rear end to accommodate the bottom section 226 of the block 206.

The front section 224 of the block 206 is generally provided to prevent replacement of the hammer 210 with a different type of hammer, such as that disclosed in FIG. 3. The front section 224 of the block 206 has a contoured surface 244 to allow the hammer 210 a full range of movement for proper operation thereof without interference, but is located in an area behind the hammer operating area and in close proximity to the path of the hammer 210 to prevent operational installation of a different type of hammer having a longer length. In the embodiment shown, the hammer 210 has a length shorter than the lengths of the hammers shown in FIGS. 2 and 3. Therefore, the hammers shown in FIGS. 2 and 3 could not be operationally installed in the lower receiver 28 because the tops of these old hammers would hit the front section 224 of the block 206 as they attempted to move backward which would in turn prevent the bolt assembly from moving to discharge an empty casing and reload the rifle with a new cartridge from the magazine.

The top section 222 of the block 206 is generally intended to prevent the use of an automatic firing bolt assembly, such as shown in FIG. 3, with the rifle 10. The top section 222 of the block 206 projects above the top of the lower receiver 28 into the bolt assembly cavity of the upper receiver 29. Bolt carriers in prior art generally have a slot in their bottom such that their hammers can strike their firing pins. However, these slots do not extend along the entire length of the bolt carrier. In fact, rear bottom sections of the bolt carriers for automatic firing rifles, such as shown in FIG. 3, are needed in order to hit and operate their automatic sear. Thus, if a bolt carrier such as that shown in FIG. 3 was attempted to be installed in the rifle 10, the top section 222 of the block 206 would hit the bottom of the bolt carrier and prevent the upper receiver 29 from completely closing onto the lower receiver, hence preventing operational installation of an automatic firing bolt assembly. As shown in FIGS. 9A and 9B, the bolt carrier 7 provided with the rifle 10 has an elongate slot 6 along the bottom of its rear and middle sections. The slot 6 is suitably sized and shaped to receive the top section 222 of the block 206 and have a full range of movement. Thus, the block 206 does not interfere with the movement of the bolt assembly 24 between battery and recoil positions. The bolt carrier 7 is very similar to bolt carriers of the prior art. However, bolt carriers of the prior art have a rear section 9 that has an enclosed bottom without a slot in their rear section. These enclosed rear sections were used in the prior art to either trigger an automatic sear, such as that described with referenced to FIG. 3 above, or to mount an automatic conversion follower to the bolt carrier. Since the block 206 prevents the firearm 10 from being used with a bolt carrier having an enclosed rear section 9, only a bolt carrier such as that shown in FIGS. 9A and 9B having slot 6 in its rear section can be used with the firearm 10. Hence, the block 206 prevents replacement of the semi-automatic firing bolt assembly 24 with a fully automatic firing bolt assembly or addition of an automatic conversion follower.

In the embodiment shown, in addition to the addition of the anti-conversion block 206, the shaped rear end of the trigger 208, length and top profile of the hammer 210, and elongated bottom slot on the bolt carrier 7; the trigger mechanism mounting and pivot pins 218 and 219 are provided as having larger diameters than as previously provided in prior art similar firearms such as those shown in FIGS. 2 and 3 above. The lower receiver pivot pin holes 246 and 247 and pivot pin holes 248 and 249 in the trigger 208 and hammer 210 are likewise larger than the holes provided in M-16 type prior art firearms. Thus, prior art automatic firing triggers and hammers will not fit into these pins. In a preferred embodiment the pins 218 and 219 are about 10 percent larger than pins used in the prior art.

Figure 4:
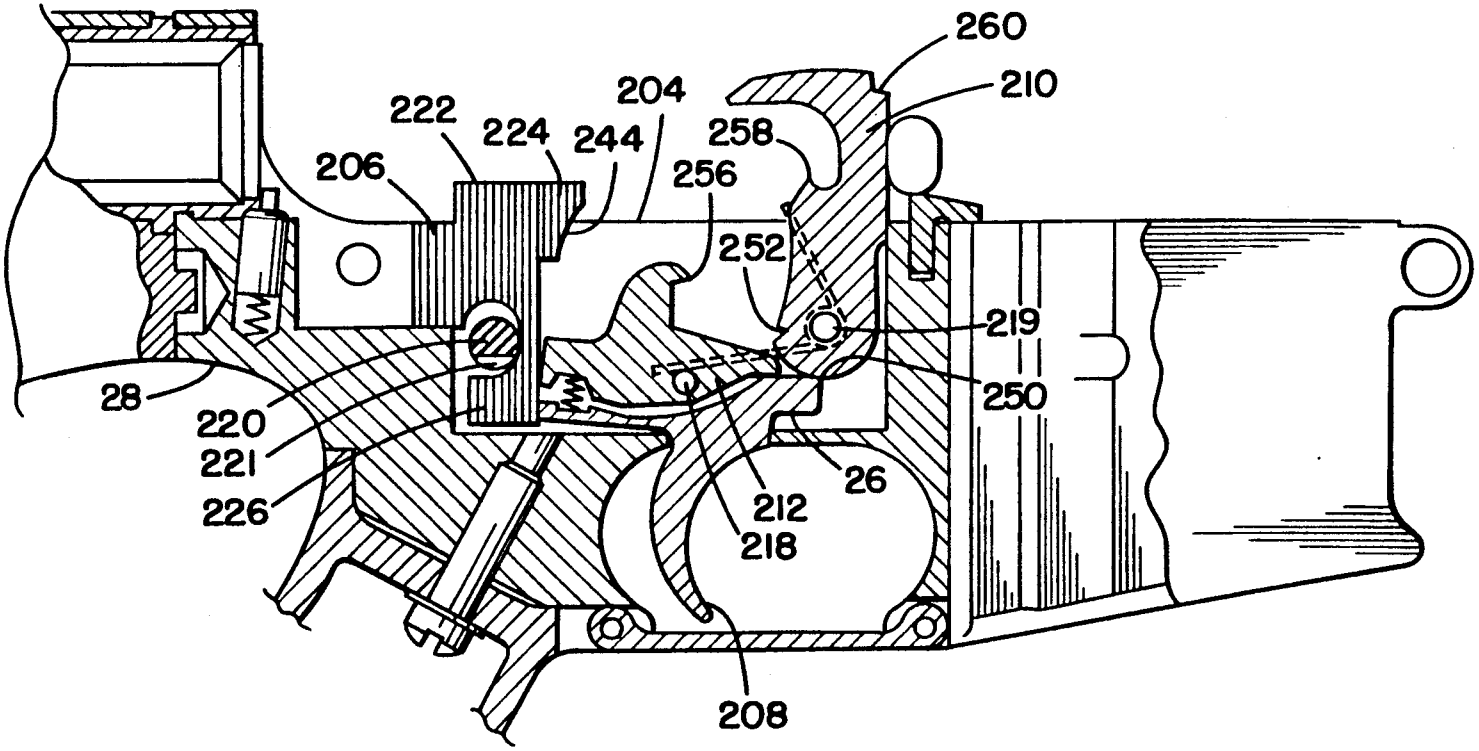
FIG. 4 is a cross-section view of the lower receiver and trigger mechanism of the firearm shown in FIG. 1 incorporating features of the present invention.
Figure 6:
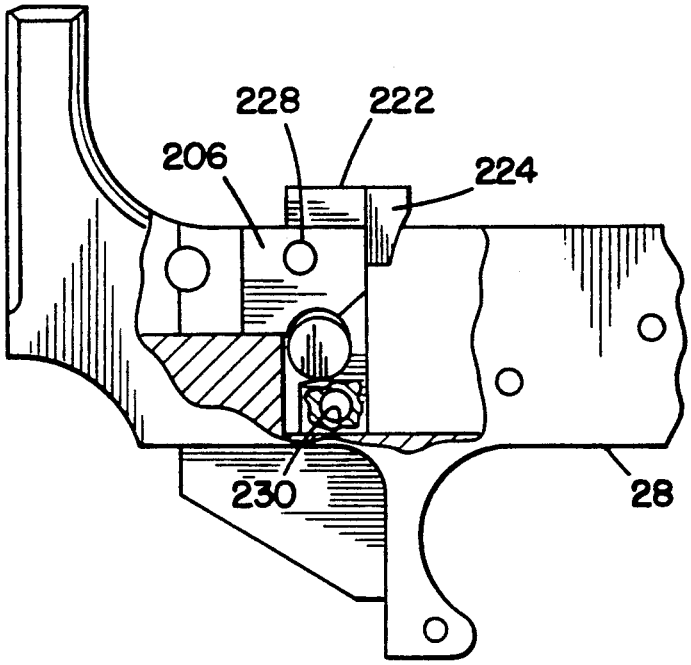
FIG. 6 is a partial cut-away schematic side view of the lower receiver of FIG. 4 showing two of the blind holes in the anti-conversion block.
Figure 7:
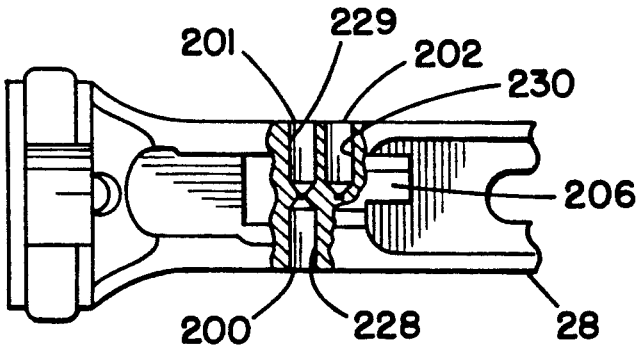
FIG. 7 is a top view of the lower receiver shown in FIG. 6 with a cut-away schematic section illustrating the location of blank holes in the anti-conversion block.
Figure 8:
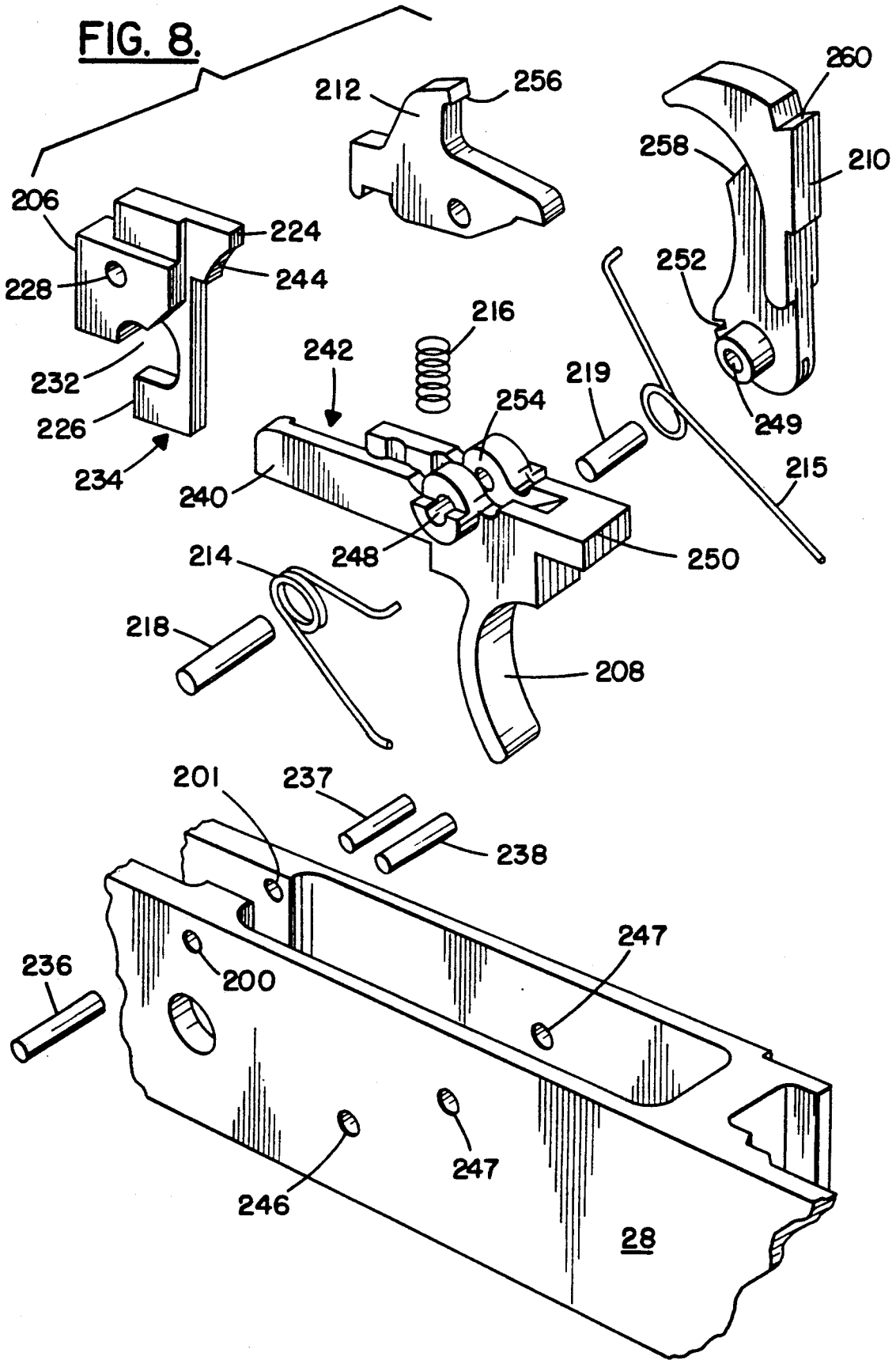
FIG. 8 is an exploded perspective view of the lower receiver and firing mechanism shown in FIG. 4.

As described above, the firing mechanism 22 of the present invention operates substantially similar to that described with reference to FIG. 2 above. The trigger 208 has a forward trigger sear 250 to cooperate with a first sear 252 on the hammer 210. The trigger 208 also has a groove 254 in its upper portion to receive a portion of the disconnector 212 and spring 216. The spring 216 is interposed between the bottom of the groove 254 and the under side of the disconnector 212 in order to urge the disconnector in a clockwise direction about pivot pin 218. The disconnector 212 has a sear abutment 256 intended to engage a second hammer sear abutment 258. The trigger 208 is biased in a counterclockwise direction by spring 214 and hammer 210 is biased in a clockwise direction by spring 215. The hammer 210 also has a bolt assembly sear abutment 260 to engage a sear abutment (not shown) on the bottom of the bolt assembly, or hook the rear of the firing pin, to prevent automatic firing in the event the disconnector is damaged or altered. The safety or selector switch 220 in the embodiment shown generally has two position; a safe position and an off or semi-automatic firing position. In the safe position, the switch 220 prevents the trigger 208 from being sufficiently rotated about pivot pin 218 to allow the trigger sear abutment 250 from disengaging the first hammer sear abutment 252 by blocking the movement of the rear portion 240 of the trigger 208. Upon movement of the switch 220 to its off position, the switch is rotated to move notch 221 to its bottom position as shown in FIG. 4. The rear portion 240 of the trigger 208 can now move upwardly enough in the block second notch 234 and the safety switch notch 221 to allow the trigger sear abutment 250 to disengage the hammer first sear abutment 252 when the shooter pulls the trigger 208.

With the hammer in its cocked position and the bolt assembly in its battery position, when a shooter pulls the trigger 208 the trigger sear abutment 250 disengages the hammer first sear abutment 252. The hammer 210 then swings upwardly forward under the bias of spring 215 about its mounting pivot 219. During the upward swinging of the hammer 210 it passes through the bottom slot 6 and strikes the firing pin 300. The pin hits the rear of a chambered cartridge that fires. The gases cause the bolt assembly to recoil to its recoil position and urges the hammer 210 back and downward about its pivot pin 219. The top of the hammer 210, due to its shape and size, can pass in front of and in close proximity to the front section 224 of the block 206. The hammer 210 thus is allowed to move out of the path of the recoiling bolt assembly and is engaged by either the disconnector sear abutment 256 or trigger sear abutment 250. If engaged by the disconnector sear abutment 256, the shooter must release the trigger 208 in order to move the disconnector 212 out of engagement with the hammer 210 in order to fire the rifle again. While releasing the trigger 208, the trigger sear abutment 250 engages the first hammer sear abutment 252 to hold the hammer in its cocked position until the shooter once again pulls the trigger 208 to fire the rifle. Because the top section 222 of the anti-conversion block 206 is received in the slot 6 of the bolt carrier 7, the block does not obstruct the movement of the bolt assembly 24. Thus, the rifle 10 will only operate with a predetermined type of bolt assembly; i.e.: a bolt assembly having a properly sized elongate bottom slot along substantially its entire length. In addition, because the front section 224 of the anti-conversion block 206 projects into an area in close proximity to the operational path of the hammer 210, the rifle will only operate with a predetermined type of hammer; i.e.: a hammer having a proper length and shaped top to allow passage past the block front section 224. The presence of the bottom section 226 of the block 206 in the cavity 204 prevents the replacement of the trigger 208 with prior art triggers. Even if someone were to attempt to form a gap in a prior art trigger, such as gap 242, to accommodate block bottom section 226, the counterfeit trigger could not be properly mounted into the lower receiver 28 due to the use of enlarged pivot pin 218. In addition, even if someone were to attempt to reduce the length of a prior art hammer and shape its top to accommodate the front section of the block 206, the counterfeit hammer could not be properly mounted into the lower receiver 28 due to the use of enlarged pivot pin 219. The presence of the block 206 in the lower receiver 28 also prevents the installation of an automatic sear into the rifle. In addition to the presence of block 206 in an area of the lower receiver 28 that might otherwise have an automatic sear installed thereinto, in the very unlikely event that the block 206 or a portion of the block was removed by a person in an attempt to illegally install an automatic sear, such as sear 110 shown in FIG. 3, the upper pins 237 and 238 are suitably located in the lower receiver 28 to also prevent installation of an automatic sear. In addition, the size and location of the upper pin holes 200 and 201 in the lower receiver 28 would also prevent proper operational installation of an automatic sear at the traditional autosear location. As noted above, the block 206 is preferably made of steel and may be comprised of hardened steel as its mounting pins 236–238. Because the pin holes 228–230 are blind holes into which the pins 236–238 are press fit into at offset locations, the block 206 would be extremely difficult to remove from the lower receiver 28. This allows the use of M-16 style upper and lower receivers, with larger pivot holes 246–247 and pin holes 200–202 therein, to be sold as a semi-automatic firearm without substantial risk of the rifle 10 being converted into an automatic firearm. This, of course, allows a manufacturer to use substantially the same set of tools in making receivers for both automatic and semi-automatic firearms and, by taking a receiver for an automatic firearm and merely making holes 200–202 and enlarging holes 246–247, provide a receiver for the semi-automatic rifle 10. Thus, tooling cost are reduced and inventory costs to provide both automatic and semi-automatic firearms of similar exterior appearance is also reduced. In addition, the present invention allows firearm purchasers to be able to purchase a firearm similar to an M-16, which they may already be familiar with because of prior military service, but as a semi-automatic version with a significantly reduced risk that the rifle 10 could be. converted into an automatic firearm. Thus, the present invention provides a semi-automatic firearm similar in appearance to an M-16, without significant manufacturers retooling costs, and with greater added safety to the public by significantly preventing conversion to an automatic firearm.

Let it be understood that the the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An anti-conversion block for use in a semi-automatic firearm for preventing conversion of the firearm to a fully automatic firearm, the block comprising:

a first section having means for preventing operational installation of a predetermined type of trigger into the firearm;

a second section having means for preventing the operational installation of a predetermined type of hammer in the firearm; and a third section having means for preventing the operational installation of a predetermined type of bolt assembly into the firearm.

2. A block as in claim 1 wherein the block is comprised of hardened steel.

3. A block as in claim 1 wherein the block comprises offset blind holes for insertion of mounting pins that can be press fit into said holes to fixedly mount the block to a receiver of the firearm.

4. A block as in claim 1 wherein the block comprises a recess for passage of a safety selector therethrough.

5. A block as in claim 1 wherein said first section is suitably sized to allow passage of a portion of a trigger assembly therepast to contact a safety selector.

6. In a semi-automatic firing mechanism of the type having a receiver; a bolt assembly mounted for longitudinal movement in the receiver between recoil and battery positions; a hammer pivotally mounted in the receiver such that movement of the bolt assembly from the battery position to the recoil position urges the hammer into a cocked position; a firing pin slidably mounted in the bolt assembly adapted to be displaced into engagement with a cartridge upon being struck by the face of the hammer, wherein the improvement comprises:

an anti-conversion block fixedly mounted in the receiver adapted to prevent the conversion of the semi-automatic firing mechanism into a fully automatic firing mechanism.

7. A firing mechanism as in claim 6 further comprising said block having blind holes for receiving press fit hardened steel mounting pins for permanently mounting said block to the lower receiver.

8. A firing mechanism as in claim 6 wherein said block comprises means adapted to prevent installation of an automatic sear into the receiver.

9. A semi-automatic firearm having a barrel, an upper receiver, a reciprocating bolt movably mounted inside the upper receiver, a firing pin slidably mounted in the bolt, and a lower receiver having a trigger actuated firing mechanism, wherein the improvement comprises:

an anti-conversion block fixedly mounted to the lower receiver, said block having a forward section extending into an area behind a hammer operating area of the firing mechanism that does not interfere with the operation of a first type of hammer, but upon replacement of the first type of hammer with a second type of hammer, prevents operation of the second type of hammer by blocking the second type of hammer from full reward movement, and said block having holes that mounting members are fixed into to substantially permanently fixedly mount said block to the lower receiver.

10. A semi-automatic firearm having a barrel, an upper receiver, a reciprocating bolt movably mounted inside the upper receiver, a firing pin slidably mounted in the bolt, and a lower receiver having a trigger actuated firing mechanism, wherein the improvement comprises:

an anti-conversion block fixedly mounted to the lower receiver, said block having a bottom section extending into a portion of an area behind a trigger mechanism adapted to prevent replacement of the trigger mechanism with a different type of trigger mechanism, said block having a first notch with a safety switch movably located therein and a second notch connected to the first notch with a portion of the trigger mechanism movably located therein.

11. A semi-automatic firearm having a barrel, an upper receiver, a reciprocating bolt assembly movably mounted inside the upper receiver, a firing pin slidably mounted in the bolt assembly, and a lower receiver having a trigger actuated firing mechanism, wherein the improvement comprises:

an anti-conversion block fixedly mounted to the lower receiver by pins that are press fit into holes in said block to permanently mount said block to the lower receiver, said block having a top section extending into the upper receiver and the bolt assembly having an elongate slot for receiving said top section and being movable relative thereto such that upon replacement of said bolt assembly with a different type of bolt assembly not having at least as long an elongate slot, the firearm is unable to operate properly.

12. A method of manufacturing a semi-automatic firearm comprising the steps of:

providing a lower receiver with a cavity for housing a firing mechanism;

mounting an anti-mechanism block in the cavity of the receiver, the block having a notch adapted to allow movement of a portion of the trigger mechanism therein, the block being fixedly attached to the lower receiver by press-fitting at least one pin through the lower receiver into a hole in the block; and mounting a trigger and hammer mechanism of the firing mechanism in the cavity.

13. A method as in claim 12 further comprising the step of mounting a fire control selector on the lower receiver, the selector projecting into the lower receiver cavity and being movable on the lower receiver.

14. A method as in claim 13 wherein the step of mounting the fire control selector comprises positioning a portion of the selector in a cavity of the block.

15. A block as in claim 1 wherein said first section comprises a notch adapted to allow a portion of a trigger to be movably located therein, said second section comprises a curved front of said block, and said third section comprises a lug extending from a top of said block.

* * * * *